United States Patent [19]

Uher

[11] 4,274,620

[45] Jun. 23, 1981

[54] ANCHOR WINDLASS

[75] Inventor: Edmond Uher, Oberägi, Switzerland

[73] Assignee: Dieter Delwing, Zug, Switzerland

[21] Appl. No.: 79,544

[22] Filed: Sep. 27, 1979

[30] Foreign Application Priority Data

Sep. 30, 1978 [DE] Fed. Rep. of Germany ..... 2842814

[51] Int. Cl.[3] ..... B66D 1/14

[52] U.S. Cl. ..... 254/351; 192/94

[58] Field of Search ..... 254/350, 351, 317, 305, 254/299, 365, 346; 192/12 B, 19, 94, 12 R, 17 C, 17 A, 17 R

[56] References Cited

U.S. PATENT DOCUMENTS

| | | | |
|---|---|---|---|
| 1,125,152 | 1/1915 | Newdick | 254/351 X |
| 1,473,248 | 11/1923 | Norris | 192/94 X |
| 3,744,760 | 7/1973 | Uher | 254/351 |

*Primary Examiner*—Peter Feldman

*Attorney, Agent, or Firm*—Karl F. Ross

[57] ABSTRACT

An anchor windlass has a shaft on which an anchor-line sprocket is freely rotatable between an abutment fixed axially on the shaft and an entrainment emenet fixed rotationally but axially shiftable on this shaft. A nut threaded on the shaft bears via a stack of spring washers on this entrainment element and can be screwed axially forwardly on the shaft to wedge the sprocket between the entrainment element and the abutment to rotationally couple the sprocket to the shaft, and can be screwed axially backwardly on the shaft to allow free rotation of this sprocket on the shaft. A pawl and cam mechanism serves to automatically rotationally temporarily arrest the nut to screw it in the desired direction for coupling the sprocket to the shaft or uncoupling it therefrom.

10 Claims, 3 Drawing Figures

ANCHOR WINDLASS

FIELD OF THE INVENTION

The present invention relates to a winch. More particularly this invention concerns a powered anchor windlass.

BACKGROUND OF THE INVENTION

An anchor windlass typically has a wheel either constituted as a capstan, sprocket, drum, or barrel that can be rotated at low speed with high torque to haul in an anchor. Normally to drop anchor the sprocket is allowed to rotate freely, although it is also normally desired to drive the sprocket in both directions to pay out a sufficient anchor line or rode to obtain the desired scope.

A typical such windlass has a wheel which is rotatable and limitedly axially displaceable on the windlass shaft. An abutment is axially fixed on the shaft to one side of this wheel and an entrainment element on the other side of this wheel is axially shiftable but rotationally coupled to the wheel. Mechanism normally including a nut threaded to the shaft can axially press the entrainment element forwardly against the wheel to wedge this wheel between the entrainment element and the abutment, thereby rotationally coupling the wheel to the shaft. Opposite rotation of the nut releases the wheel to rotate freely on the shaft. In such an arrangement a pawl can be used to rotationally arrest the nut, so that when the shaft is rotated in one direction the nut will move forwardly to lock the wheel on the shaft, and when the shaft is rotated in the opposite direction the nut will be screwed backwardly.

It is also known to form the entrainment element and nut integrally, so that the entrainment element is in effect simply screwed into tight contact with the wheel. Such an arrangement has the advantage of considerable simplicity, and is capable of exerting enormous axial forces on the wheel to lock it rotationally tightly in place, as the wheel must be able to exert considerable force on the anchor line to haul anchor.

These systems have several disadvantages. In the first above-described system the mechanism is subject to normally very abrupt forces during the coupling-up and uncoupling of the wheel. Thus the mechanism must be made extremely robust, and even so can be counted on to need periodic expensive servicing. In the other arrangement considerable forces must be brought to bear not only to lock the wheel on the shaft, but also to uncouple the wheel from the shaft. The considerable frictional forces lead to rapid wear and, hence, once again make the system relatively service-prone.

OBJECTS OF THE INVENTION

It is therefore an object of the present invention to provide an improved winch.

Another object is to provide an anchor windlass which overcomes the above-given disadvantages.

SUMMARY OF THE INVENTION

These objects are attained according to the instant invention in a winch of the above-described general type, wherein the wheel carrying the flexible element constituting the anchor line or rode is flanked by an abutment axially fixed on the shaft and on entrainment element rotationally fixed but axially shiftable on the shaft. According to this invention a nut threaded on the shaft bears via a heavy-duty compression spring, advantageously formed as a stack of spring or Belleville washers, on the entrainment element. In fact a roller bearing may be provided between the nut and the entrainment element, to one side or the other of the compression spring, so that the nut will be able to bear with steadily increasing and decreasing axial force on the entrainment element and therethrough on the wheel. Thus the shocks to which the other above-described systems are typically subjected are largely avoided, while at the same time it is possible in a relatively simple manner to transmit considerable torque between the shaft and the wheel.

According to further features of this invention the nut has an outwardly extending disk formed with a notch in which the arresting pawl can engage to rotationally arrest the nut. A cam is provided which pushes the pawl out of the notch in forward and backward positions of the nut corresponding to engaged and disengaged positions of the wheel on the shaft.

Thus with the system according to the instant invention to haul anchor the motor or crank which rotates the shaft is operated in one direction while the pawl is engaged in the notch of the nut to screw it forwardly and clamp the wheel tightly on the shaft. When the nut reaches the forward end position the pawl is disengaged and further rotation of the shaft rotates the nut and wheel jointly to haul the anchor up. A limit switch normally shuts off this motor when the anchor is all the way up. To pay out the anchor line the rotation direction of the shaft is reversed and the pawl is again engaged in the notch. For the first several rotations the wheel rotates in the reverse direction, while the nut is screwed away from the wheel until the entrainment element disengages from the wheel and allows it to rotate freely on the shaft, thereby dropping the anchor which will descend at its inertia speed. Once the nut moves fully into its backward position the cam pushes the pawl out of engagement with the cam and a limit switch normally shuts off the drive motor.

SPECIFIC DESCRIPTION

Figure 1:
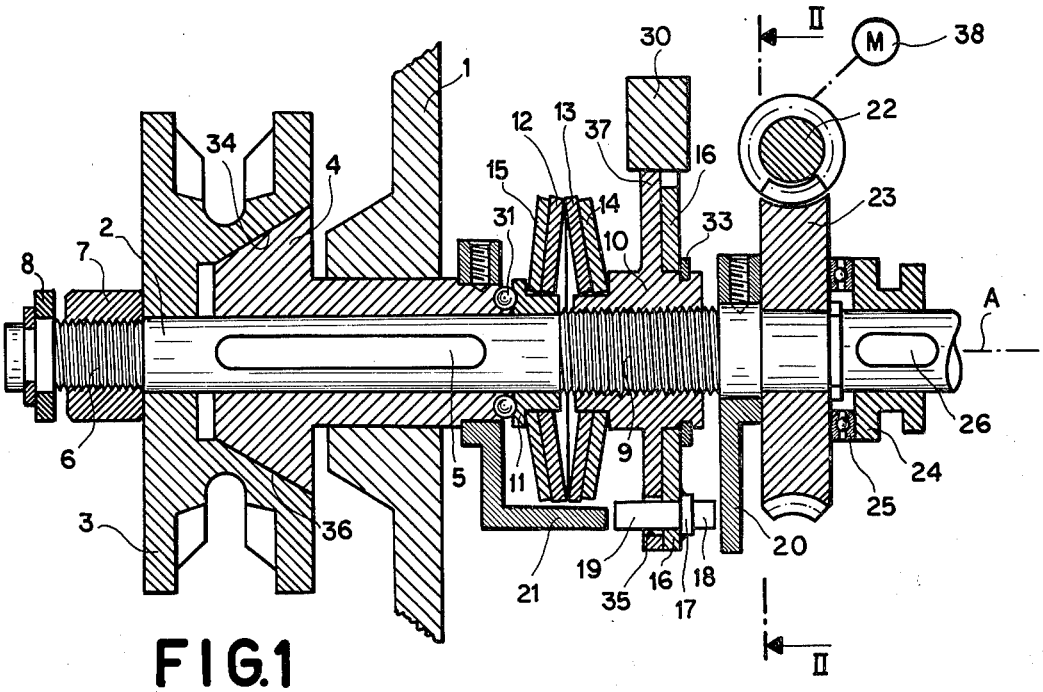
FIG. 1 is an axial section through the apparatus according to this invention.

The windlass according to the instant invention as seen in FIG. 1 has a housing 1 in which a shaft 2 is rotatable about an axis A on which the shaft 2 is centered. A sprocket 3, which could be replaced by a capstan, barrel, or the like, is rotatable on the shaft 2 about the axis A. The shaft 2 has a threaded end 6 lying axially forwardly of the sprocket 3. An abutment nut 7 is threaded on this end 6 and its axial displacement in the forward direction is limited by a snap ring 8 fitted on the extreme tip of the shaft 2.

An entrainment element 4 is axially displaceable forwardly and backwardly on the shaft 2, but is rotationally coupled to the shaft 2 by a key 5. This entrainment element 4 has a frustoconical surface 36 complementary and fittable with a frustoconical recess 34 of the wheel 2. Thus displacement of the element 4 axially forwardly, that is to the left in FIG. 1, will fit the surfaces 34 and 36 together and press the wheel 3 against the abutment nut 7 so as to rotationally lock this wheel 3 on the shaft 2. Opposite displacement, to disengage the surfaces 34 and 36 from each other, allows the sprocket 3 to rotate freely on the shaft 2.

In addition the shaft 2 is formed axially backwardly from the entrainment element 4 with a further threaded region 9 on which a nut 10 formed with a flange 37 is threaded. This nut 10 bears axially forwardly via four Belleville washers 12–15 on a ring 11 that is freely rotatable and axially shiftable on the shaft 2 and that bears via a roller bearing 31 on the rear end of the entrainment element 4 which is basically formed as a tube or sleeve.

As its rear end the shaft 2 is connected via a key 26 to a clutch plate 24 engageable via clutch jaws 25 with a drive gear 23 rotatable by means of a worm 22 itself rotatable by a reversible electrical motor 38 or by a hand crank if desired. Thus high-speed rotation of the worm 22 is transformed into low-speed high-torque rotation of the shaft 2.

Figure 2:
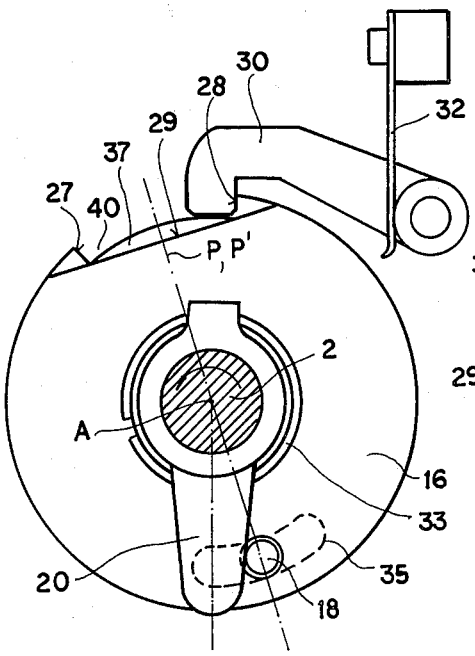
FIG. 2 is a section taken along line II—II of FIG. 1.
Figure 3:
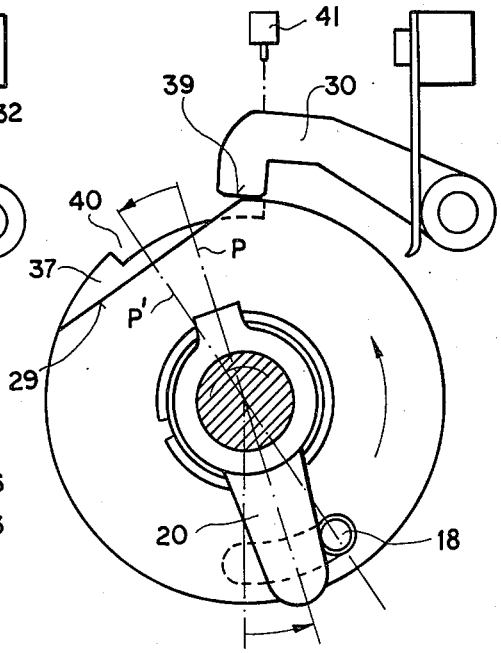
FIG. 3 is a view similar to FIG. 2 showing the mechanism in a different operative position.

A pawl 30 has a tip 39 engageable in a cutout 40 in the rim of the disk 37 formed on the nut 10. This cutout 40 has a pair of end flanks 27 and 28 which lie in respective planes including the axis A and flanking a plane P also including this axis A and extending through the middle, measured angularly, of the notch 40. The tip 39 of the pawl 30 is similarly squared off, so that it can block rotation of the disk 37 and of the nut 10 in either direction when pressed radially into the notch 40. A leaf spring 32 holds the pawl 30 in whatever position it is in, whether engaged in the notch 40 as seen in FIG. 2 or when out of the notch 40 as seen in FIG. 3. A solenoid 41 may radially displace the tip 39 of the pawl 30, or this pawl 30 can be simply operated by hand.

A cam disk 16 is limitedly rotatable on the nut 10, lying between the disk flange 37 and a snap ring 33 on the nut 10. This cam 16 is formed with a flat 29 centered on a plane P′ and so dimensioned that when the planes P and P′ coincide the tip 39 of the pawl can enter the notch 40. In addition this cam 16 is fitted with a pin 17 extending parallel to the axis A and having a pair of opposite ends 18 and 19 respectively engageable with abutments 20 and 21 respectively carried on the shaft 20 and entrainment element 4. This pin 17 passes through an arcuate slot 35 in the flange disk 37 of the nut 10 so that the cam 16 can move from the central position shown in FIG. 2, with the planes P and P′ coincident and the pin 17 lying in the center of the slot 35, into either of a pair of end positions one of which is shown in FIG. 3.

To uncouple the wheel 3 from the shaft 2 the pawl 30 is pressed radially inwardly against the nut 10 while this nut 10 is rotated counterclockwise as seen in FIGS. 2 and 3. This will cause the tip 39 to drop into the notch 40 and engage against the one flank 28 of the notch 40 so as to prevent further counterclockwise rotation of the nut 10. This action will screw the nut 10 axially backwardly, to the right in FIG. 1, on the shaft 2 until the tip 18 of the pin 17 is angularly engaged by the abutment 20 mounted on the shaft 2 and rotating counterclockwise therewith. When the abutment 20 engages this tip 18 as seen in FIG. 3 it shifts the cam 16 slightly counterclockwise so as to cam the pawl 30 upwardly out of the notch so that thereafter the nut 10 will rotate jointly with the shaft 2. In this position the nut 10 will be sufficiently withdrawn axially backwardly that the wheel 3 will be rotationally uncoupled from the shaft 2.

Opposite rotation of the shaft 2 while pressing the pawl 30 inwardly will be effective in the same manner so as to screw the nut 10 forwardly, to the left in FIG. 1, on the shaft 2. The force exerted through the spring pack 12–15 on the entrainment element will increase until the entrainment element 4 locks the wheel 3 rotationally on the shaft 2. At approximately the same time this happens the tip 19 of the pin 17 will angularly engage the abutment 21 carried on the entrainment element 4 and will cam the tip 39 out of engagement with the flank 27 of the notch 40 to allow joint rotation of the nut 10 and the shaft 2.

The axial positions at which the above-described mechanism operates to uncouple the nut 10 from the pawl 30 can be established by axially positioning the adjustable abutments 20 and 21 on the shaft 2 and entrainment element 4. Similarly the nut 7 can be screwed in and out to adjust the closing force to be exerted by the spring pack 12–15.

The system according to the instant invention, therefore, will smoothly couple and decouple the wheel 3 from the shaft 2. There will be no sudden shocks or jarrings in the system due to the use of the spring pack 12–15 so that a long service life can be assured.

I claim:

1. A winch comprising:

a housing;

a shaft centered on and rotatable about a shaft axis in said housing;

a wheel rotatable on said shaft about said axis, whereby a flexible element can be spanned over said wheel;

an abutment axially fixed on said shaft and juxtaposed with said wheel;

an entrainment element rotationally fixed but axially displaceable on said shaft and engageable with said wheel, whereby said element can be moved axially forward into engagement with said wheel to wedge same against said abutment and rotationally couple said wheel to said shaft;

a nut threaded on said shaft adjacent said entrainment element;

a compression spring braced axially between said nut and said entrainment element for force transmission therebetween; and means including a pawl for temporarily rotationally arresting said nut, whereby, when said shaft is rotated in one direction with said nut rotationally arrested, said nut will be screwed forwardly on said shaft to bear via said spring on said entrainment element.

2. The winch defined in claim 1 wherein said compression spring is a stack of Belleville washers surrounding said shaft between said nut and said entrainment element.

3. The winch defined in claim 1 wherein said wheel has a frustoconical recess centered on said axis and said entrainment element has a frustoconical surface snugly fittable in said recess.

4. The winch defined in claim 1 wherein said nut has a flange formed with a radially outwardly open recess in which said pawl is engageable, said means further comprising a cam for pushing said pawl out of said recess in each of two axially offset positions of said nut on said shaft.

5. The winch defined in claim 1, further comprising an axial thrust bearing on said shaft between said nut and said entrainment element, whereby said nut and entrainment element can rotate about said axis independently of each other.

6. The winch defined in claim 5 wherein said bearing is between said compression spring and said entrainment element.

7. The winch defined in claim 1 wherein said nut has a flange formed with a radially outwardly open recess in which said pawl is engageable and with an arcuate slot, said means further comprising a cam for pushing said pawl out of said recess and having a pin projecting through said slot and displaceable from a central position therein into either of two end positions in which said cam prevents said pawl from rotationally arresting said nut in a respective rotational sense of said shaft.

8. The winch defined in claim 7, further comprising cam abutments coupled to said shaft and angularly engageable with said pin to rotationally displace said cam into the respective end positions.

9. The winch defined in claim 1 wherein said wheel is an anchor-line sprocket.

10. The winch defined in claim 1, further comprising drive means for rotating said shaft about said axis in either of two opposite rotational senses.

* * * * *